United States Patent [19]

Davis

[11] Patent Number: 4,826,222

[45] Date of Patent: May 2, 1989

[54] CLOSURE LATCH

[75] Inventor: Ronald P. Davis, Wellington, New Zealand

[73] Assignee: Interlock Industries Limited, Wellington, New Zealand

[21] Appl. No.: 112,702

[22] Filed: Oct. 26, 1987

[51] Int. Cl.[4] ..... E05C 3/04

[52] U.S. Cl. ..... 292/241; 292/197; 292/200; 292/204; 292/DIG. 9; 292/DIG. 20; 292/DIG. 38

[58] Field of Search ..... 292/197, 200, 204, 229, 292/224, 226, 240, 241, DIG. 9, DIG. 16, DIG. 38, DIG. 47, DIG. 20

[56] References Cited

U.S. PATENT DOCUMENTS

| | | | |
|---|---|---|---|
| 820,868 | 5/1906 | Hinchliffe | 292/DIG. 20 X |
| 1,613,315 | 1/1927 | Dols | 292/197 X |
| 1,642,512 | 9/1927 | Schrader | 292/197 X |
| 1,691,485 | 11/1928 | Kirk | 292/204 |
| 1,841,890 | 1/1932 | Hannon | 292/204 |
| 3,645,573 | 2/1972 | Strang | 292/DIG. 38 X |
| 3,969,788 | 7/1976 | McCullough | 16/326 |
| 3,991,437 | 11/1976 | Friederichs | 16/139 |
| 4,230,351 | 10/1980 | Bisbing | 292/223 |
| 4,305,612 | 12/1981 | Hunt et al. | 292/336.3 |

FOREIGN PATENT DOCUMENTS

| | | | |
|---|---|---|---|
| 785176 | 5/1968 | Canada | 292/197 |
| 133051 | 2/1985 | European Pat. Off. | 292/210 |
| 2432143 | 6/1974 | Fed. Rep. of Germany . | |
| 399401 | 4/1909 | France | 292/226 |
| 2171874 | 9/1973 | France . | |
| 1255189 | 12/1971 | United Kingdom . | |
| 1339298 | 11/1973 | United Kingdom . | |
| 1408773 | 10/1975 | United Kingdom . | |

*Primary Examiner*—Lloyd A Gall
*Assistant Examiner*—Curtis B. Brueske
*Attorney, Agent, or Firm*—Young & Thompson

[57] ABSTRACT

A latch having a base and a latch plate pivoted thereto, the base being adapted for installation on a closure frame and the latch plate being adapted to overlie the closure. The latch plate is pivotally mounted on the base to swing between an unlatched position in which the closure can be opened, and a latched position in which the closure cannot be opened because the latch plate overlies it. A handle pivotally mounted on the base swings the latch plate between the open and closed positions. At least one of the base and latch plate are made of an elastically deformable material. The latch plate is moved to the latching position by the camming action of the handle; and when the latch plate has moved only part way toward the fully latched position, abutment surfaces on the base and latch plate come into contact with each other. Thereafter, as the handle moves to the fully latched position, the resilient material of the base and/or latch plate is resiliently deformed, so that when the handle reaches the fully latched position, the deformation of the resilient material will cause the latch plate to exert a force on the handle, thereby increasing the friction between the latch plate and the handle to prevent accidental or unauthorized movement of the handle toward the unlatched position.

5 Claims, 3 Drawing Sheets

FIG. 1
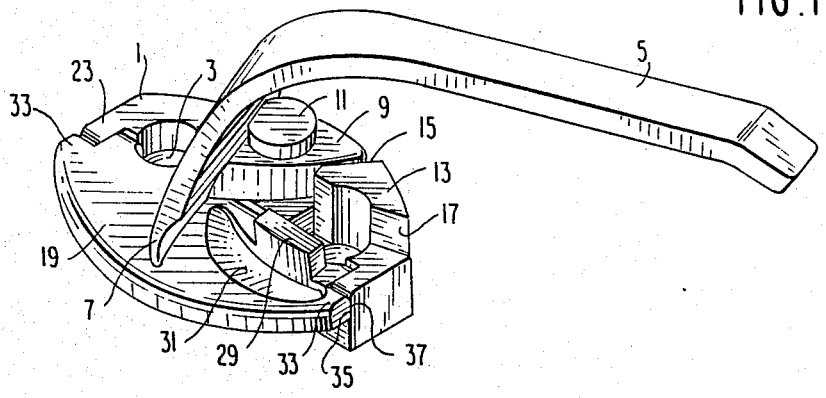
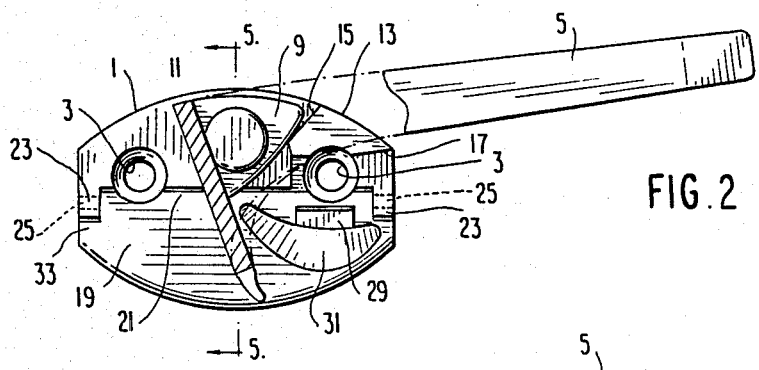
FIG. 2
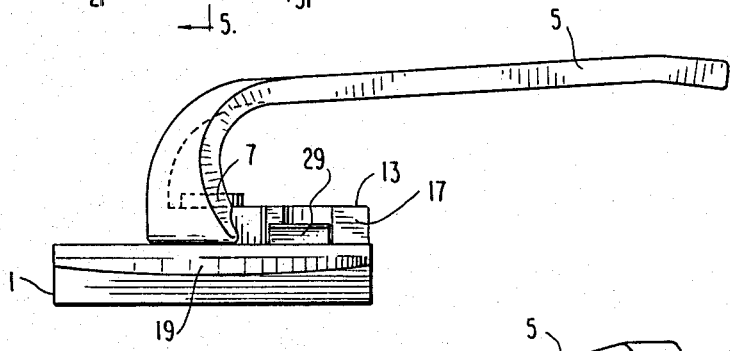
FIG. 3
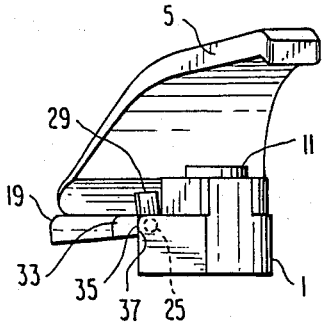
FIG. 4

CLOSURE LATCH

FIELD OF THE INVENTION

The present invention relates to a latch for a closure such as a window or door, for releasably holding the closure in a closed position in a frame.

OBJECTS OF THE INVENTION

It is an object of the present invention to provide such a closure that can be applied to the frame as a unit and that does not require a separate striker or wedge plate.

Another object of the present invention is the provision of such a latch, which in its latching position is releasably secured against inadvertent or unauthorized opening.

Finally, it is an object of the present invention to provide such a latch, which will be simple and inexpensive to manufacture, easy to install, and rugged and durable in use.

BRIEF SUMMARY OF THE INVENTION

Briefly stated, the present invention comprises a latch having a base and a latch plate pivoted thereto, the base being adapted for installation on a closure frame and the latch plate being adapted to overlie the closure. The latch plate is pivotally mounted on the base to swing between an unlatched position in which the closure can be opened, and a latched position in which the closure cannot be opened because the latch plate overlies it. A handle pivotally mounted on the base swings the latch plate between the open and closed positions.

At least one of the base and latch plate are made of an elastically deformable material. The latch plate is moved to the latching position by the camming action of the handle; and when the latch plate has moved only part way toward the fully latched position, abutment surfaces on the base and latch plate come into contact with each other. Thereafter, as the handle moves to the fully latched position, the resilient material of the base and/or latch plate is resiliently deformed, so that when the handle reaches the fully latched position, the deformation of the resilient material will cause the latch plate to exert a force on the handle, thereby increasing the friction between the latch plate and the handle to prevent accidental or unauthorized movement of the handle toward the unlatched position.

BRIEF DESCRIPTION OF THE DRAWINGS

Other objects and features of the present invention will become apparent from a consideration of the following description, taken in connection with the accompanying drawings, in which:

FIG. 1 is a perspective view of a latch according to the present ,invention, in the fully latched position;

FIG. 2 a plan view thereof, with the parts in the FIG. 1 position, and with a part of the handle broken away for clarity;

FIG. 3 is a side elevational view from the bottom of FIG. 2;

FIG. 4 is an end elevational view from the right of FIG. 3;

DETAILED DESCRIPTION OF THE INVENTION

Figure 5:
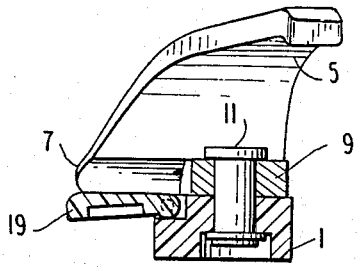
FIG. 5 is a view in the same direction as FIG. 4 but taken on the line 5—5 of FIG. 2.

Referring now to the drawings in greater detail, there is shown a latch according to the present invention, comprising a base 1 which is adapted to be secured to the frame of a closure such as a window or a door, by means of fasteners such as screws received through apertures 3 in base 1. It is intended that the line interconnecting the centers of the apertures 3 be closely adjacent and parallel to the edge of the frame on which base 1 is mounted.

A handle 5 for operating the latch terminates in one end in a projection 7 and a mounting flange 9. Flange 9 and base 1 are traversed by a pivot 11 by which handle 5 is mounted for swinging movement on and relative to base 1 about the axis of pivot 11, which axis is perpendicular to and spaced from the line mentioned immediately above. A stop 13 is integral with base 1 and upstands from the same and provides stop surfaces 15 and 17, respectively for contact with flange 9 to stop the swinging movement of handle 5 in the fully latched position and for contact with projection 7 to stop swinging movement of handle 5 in the fully unlatched position.

A latch plate 19 is pivotally mounted for swinging movement on and relative to base 1, and for this purpose is provided with a protruding edge portion 21 that occupies most of the length of latch plate 19 and is disposed between a pair of upstanding shoulders 23 on base 1. Hinges 25 pivotally interconnect edge portion 21 and upstanding shoulders 23 for mounting latch plate 19 on base 1 for swinging movement about an axis 27 parallel to the edge of the frame and the closure and perpendicular to and spaced from the axis of pivot 11.

Figure 9:
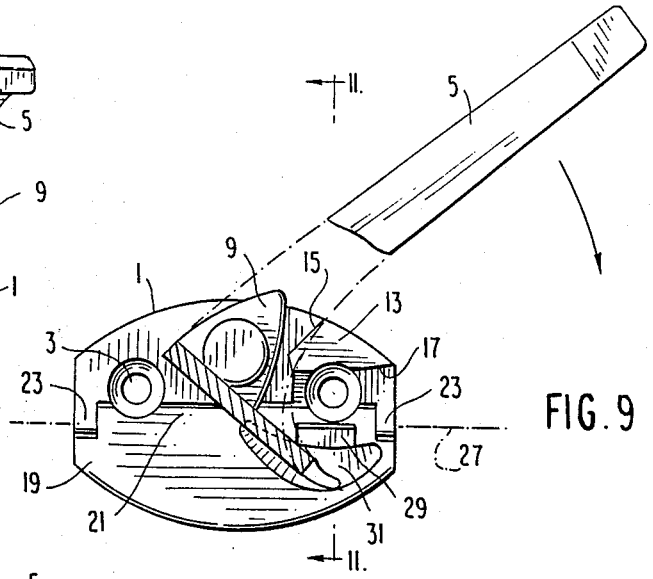
FIG. 9 is a view similar to FIG. 2 but showing the latch only partially latched, in the position in which abutment surfaces on the base and latch plate first come into contact with each other.
Figure 11:
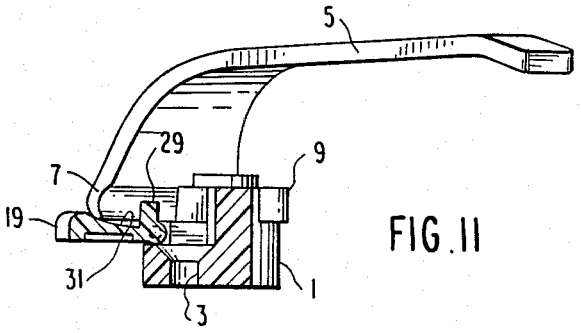
FIG. 11 is a view taken from the same direction as FIG. 10 but on the line 11—11 of FIG. 9.
Figure 8:
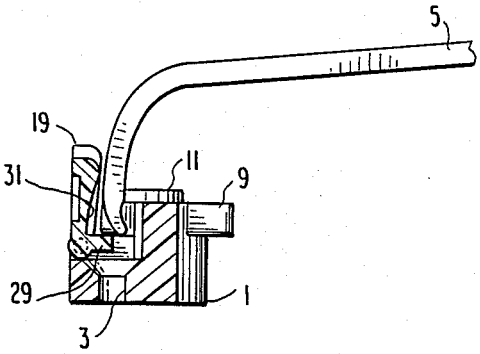
FIG. 8 is a view in the same direction as FIG. 7, but taken on the line 8—8 of FIG. 6.

To swing latch plate 19 from the fully latched to the fully unlatched position, latch plate 19 is provided with an integral upstanding lug 29 thereon, which, upon swinging movement of handle 5 in a counterclockwise direction as seen in FIGS. 2 and 9, is contacted by projection 7 on handle 5. Comparison of FIGS. 11 and 8 shows this operation. To accommodate the lower edge of projection 7 upon such swinging movement of latch plate 19 to the fully unlatched position, latch plate 19 is provided with a recess 31 immediately on the side of lug 29 opposite axis 27.

End portions 33 of latch plate 19 are recessed to receive upstanding shoulders 23 of base 1.

The material of the latch of the present invention is very important. At least one of the base 1 and latch plate 19, and preferably both, are of a hard but resiliently deformable material which can be deformed and recover its original shape as many times as the latch is to be used. Such a material is preferably a hard synthetic resin, of which a number of examples are known in the art. A preferred embodiment is injection-molded glassfiber-reinforced nylon. The material of handle 5 is relatively unimportant and can, for example, be die cast metal such as aluminum or the like.

Figure 10:
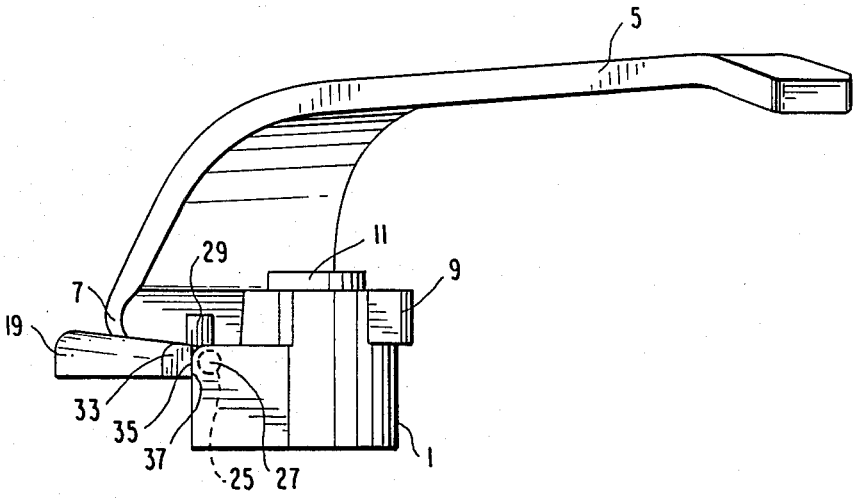
FIG. 10 is an enlarged right side view of the latch in the FIG. 9 position.

The reason why the material of base 1 and/or latch plate 19 is important, is because this material deforms in use, to provide an important feature of the present invention. To this end, base 1 and latch plate 19 are provided with abutment surfaces that come into abutting relation with each other when latch plate 19 has swung partially toward but has not yet reached the fully latched position. This is the position of the parts shown in FIGS. 9–11. In that position, it will be seen from FIG. 10 that abutment surfaces 35 on upstanding shoulders 23 of base 1 come into abutting contact with abutment surfaces 37 on end portions 33 of latch plate 19. Thereafter, as latch plate 19 is forced by the projection 7 on handle 5, from the FIG. 10 position to the FIG. 4 position, the resiliently deformable material of the base 1 and/or latch 19 is displaced to the extent necessary to permit this completion of the latching movement. The abutment surfaces 35, 37 remain in contact during this last portion of the latching movement, the resiliently deformable material adjacent one or both of them displacing under the pressure of the projection 7 against the upper surface of latch plate 19 as projection 7 cams plate 19 to the fully latched position.

Figure 6:
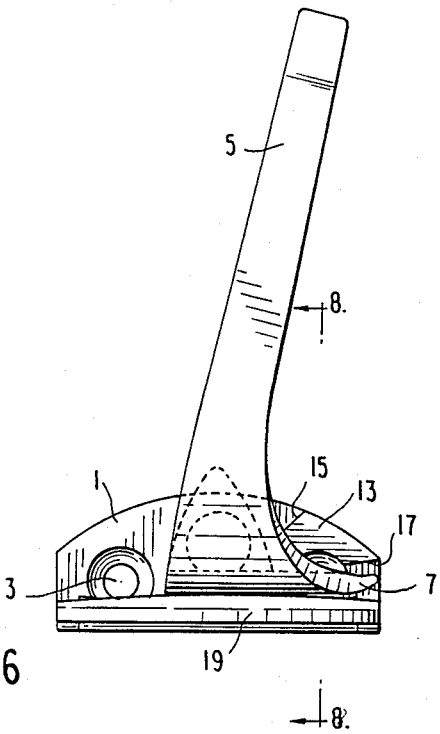
FIG. 6 is a view similar to FIG. 2 but showing the latch in the fully unlatched position.
Figure 7:
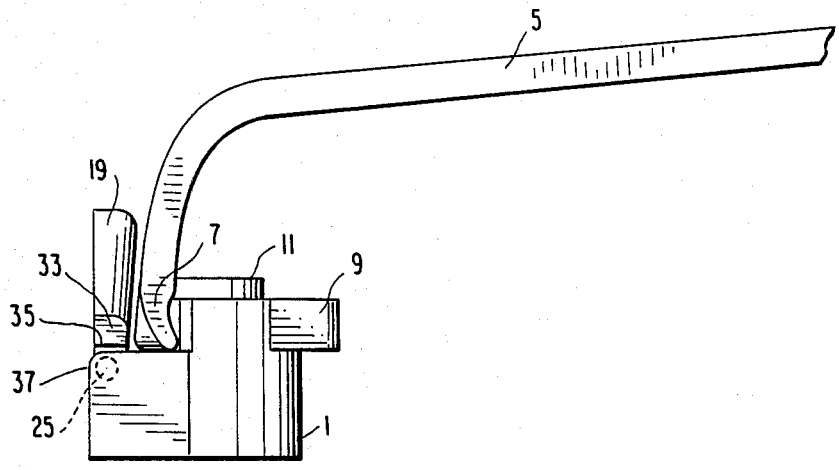
FIG. 7 is an enlarged view similar to FIG. 4 but showing the latch in the FIG. 6 position.

In operation, with the base 1 installed on the frame of the closure and the latch plate 19 overlying the closure in fully latched position, the latch can be moved to the unlatched position by swinging handle 5 counterclockwise as seen in FIG. 2 until projection 7 contacts lug 29 and swings latch plate 19 toward the unlatched position about axis 27. As previously indicated, there is considerable force between the latch plate 19 and projection 7 of handle 5, thanks to the resilient deformation of the material of the latch; and this pressure augments the friction between projection 7 and the upper surface of latch plate 19 so that handle 5 offers considerable resistance to a force tending to turn it toward the unlatched position. This of course is highly useful, to prevent inadvertent or unauthorized opening of the latch. The last portion of the swinging movement of the latch plate 19 toward the fully unlatched position is accommodated by recess 31, which receives projection 7 at this time. The movement of the latch toward the unlatched position, that is, the counterclockwise swinging movement of handle 5 as seen in the drawings, is finally arrested when projection 7 contacts surface 17 of stop 13 and the parts are in the position of FIGS. 6–8.

In the opposite direction, toward the fully latched position, handle 5 is swung clockwise as seen in the drawings. Projection 7 contacts the upper surface of latch plate 19 and cams the same toward the fully latched position. Intermediate the movement toward the fully latched position, as previously explained, the abutment surfaces 35, 37 contact each other. Thereafter, movement of the handle toward the fully latched position is resisted by the augmented friction between projection 7 and the upper surface of latch plate 19, which latch plate is urged in the unlatching direction by the resilience of the deformable material of the base 1 and/or latch plate 19. Movement of the handle 5 toward the fully latched position is arrested when flange 9 contacts surface 15 of stop 13.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A latch for releasably retaining a closure in closed position, comprising a base adapted to be secured to a frame of the closure, a latch plate pivotally mounted on the base for swinging movement between a latched position in which the latch plate overlies the closure and prevents movement thereof in the direction of the latch plate, and an unlatched position in which the latch plate is swung away from the closure to permit the closure to move past the latch plate to an open position of the closure, and a handle mounted for pivotal movement on the base about an axis perpendicular to but spaced from an axis about which said latch plate swings on the base, the handle having a projection that contacts the latch plate to swing the latch plate to the unlatched position and that swings with a cam action against the latch plate to swing the latch plate to a closed position, the base and latch plate having abutment surfaces thereon that contact each other when the handle has swung the latch plate only partly toward said closed position, the material of at least one of said base and latch plate being resiliently deformable whereby after said abutment surfaces have first contacted each other, further pivotal movement of the handle toward the fully latched position will force said resiliently deformable material to deform to permit movement of the latch plate to said fully latched position, the resilience of said material causing said latch plate to exert on said projection of said handle a force which restrains the handle against inadvertent or unauthorized opening.

2. A latch as claimed in claim 1, and a stop on the base having opposite stop surfaces which contact portions of the handle both in the fully latched and in the fully unlatched position of the handle thereby to predetermine said positions.

3. A latch as claimed in claim 1, and an upstanding lug on the latch plate, said projection contacting said lug as the handle moves toward said unlatched position thereby to swing the latch plate to said unlatched position.

4. A latch as claimed in claim 3, and a recess on the latch plate that accommodates said projection between the time said projection contacts said lug and the time the latch plate reaches said fully unlatched position.

5. A latch as claimed in claim 1, and upstanding shoulders at the ends of said base, on and between which an intermediate edge portion of said latch plate is pivotally mounted, said abutment surfaces being located on said upstanding shoulders and on end portions of said latch plate endwise beyond said intermediate edge portion of said latch plate.

* * * * *